US006971891B1

(12) United States Patent
Huang

(10) Patent No.: US 6,971,891 B1
(45) Date of Patent: Dec. 6, 2005

(54) ELECTRICAL CONNECTOR WITH SHUTTER

(75) Inventor: Chien Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/104,783

(22) Filed: Apr. 12, 2005

(30) Foreign Application Priority Data

Jul. 9, 2004 (TW) ..... 93210869 U

(51) Int. Cl.[7] ..... H01R 13/44
(52) U.S. Cl. ..... 439/137
(58) Field of Search ..... 439/135–142

(56) References Cited

U.S. PATENT DOCUMENTS 4,733,017 A * 3/1988 Wolfe-Taylor et al. ..... 439/136
4,857,004 A * 8/1989 Poirier ..... 439/136
5,026,299 A * 6/1991 Foulk ..... 439/137
5,563,373 A * 10/1996 Doroslovac ..... 439/136
5,998,735 A * 12/1999 Patterson, Jr. ..... 439/135
2002/0177336 A1 11/2002 Sasame et al.
2003/0077929 A1 4/2003 Funatsu

FOREIGN PATENT DOCUMENTS

CN 1291808 A 4/2001

* cited by examiner

*Primary Examiner*—Tho D. Ta
(74) *Attorney, Agent, or Firm*—Wei Te Chung

(57) ABSTRACT

An electrical connector (300) for mating with a mating electrical connector (500) includes an insulative housing (1), a number of terminals (4) received in the insulative housing, a shutter (2) movably assembled to the insulative housing. The insulative housing includes a mating portion (11) and a first engaging portion (16) mounted on the insulative housing, the first engaging portion comprising a limitation section (161) and a first guiding section (162). The shutter closes and opens the mating portion of the insulative housing and includes a second engaging portion (212) which mates with the first guiding section. The shutter is translating in a plane perpendicular to the mating electrical connector insertion direction between a closed portion and an open position.

11 Claims, 8 Drawing Sheets

ELECTRICAL CONNECTOR WITH SHUTTER

BACKGROUND OF THE INVENTION

1. Field of the Invention

The present invention generally relates to an electrical connector, and more particularly to an electrical connector with a shutter for dust-proof.

2. Description of Related Art

Electrical connectors are commonly used in devices, such as personal computers, for electrically connecting electronic parts mounted on circuit boards to each other. Before the electrical connectors mate with mating electrical connectors, mating portions of the electrical connectors are exposed to foreign matter, such as dust and dirt, during the mating process that can interfere with the operation of the electronic parts. Accordingly, the electrical connectors always need shutter devices for preventing the dust from entering into the interior thereof.

U.S. patent application Pub. No. 2003/0077929 discloses an electrical connector with a shutter. The electrical connector includes a mating connector fitting section and a shutter made by a pair of shutter members for closing said mating connector fitting section. The shutter member comprises a pair of arms provided at opposite ends in a lengthwise direction thereof and rotatably supported to opposite wall ends of said electrical connector for attaching said pair of shutter members to said electrical connector. And spring members for pulling said pair of shutter members toward each other, thereby covering said mating connector fitting section. The shutter members rotatablely move between a closed position and an open position.

Another conventional electrical connector with a shutter is disclosed in U.S. patent application Pub. No. 2002/0177336, the shutter of the electrical connector rotatablely move between a closed position and an open position as well.

However, according to the prior arts above, when the electrical connector is at the open position, the shutter members of the shutter are rotated to close to a printed circuit board connected with the electrical connector, or even contact said printed circuit board. So no electrical components can be arranged at the space of the printed circuit board near the side of the electrical connector, that disadvantage affects the integration of the printed circuit board. Furthermore, the structure of the shutters is complex, and the profile of the electrical connectors assembled with said shutters is high.

Hence, it is desired to provide an improved electrical connector with a shutter to overcome the aforementioned disadvantages of the prior art.

SUMMARY OF THE INVENTION

A main object of the present invention is to provide an electrical connector with a shutter to save space of a printed circuit board.

Anther object of the present invention is to provide an electrical connector with a shutter having simple structure and low-profile.

In order to achieve the object set forth, an electrical connector in accordance with the present invention includes an insulative housing, a plurality of terminals received in the insulative housing, a shutter movably assembled to the insulative housing. The insulative housing includes a mating portion and a first engaging portion mounted on the insulative housing, the first engaging portion comprising a limitation section and a first guiding section. The shutter closes and opens the mating portion of the insulative housing and includes a second engaging portion which mates with the first guiding section. The shutter moves in a plane perpendicular to the mating electrical connector insertion direction between a closed portion and an open position.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
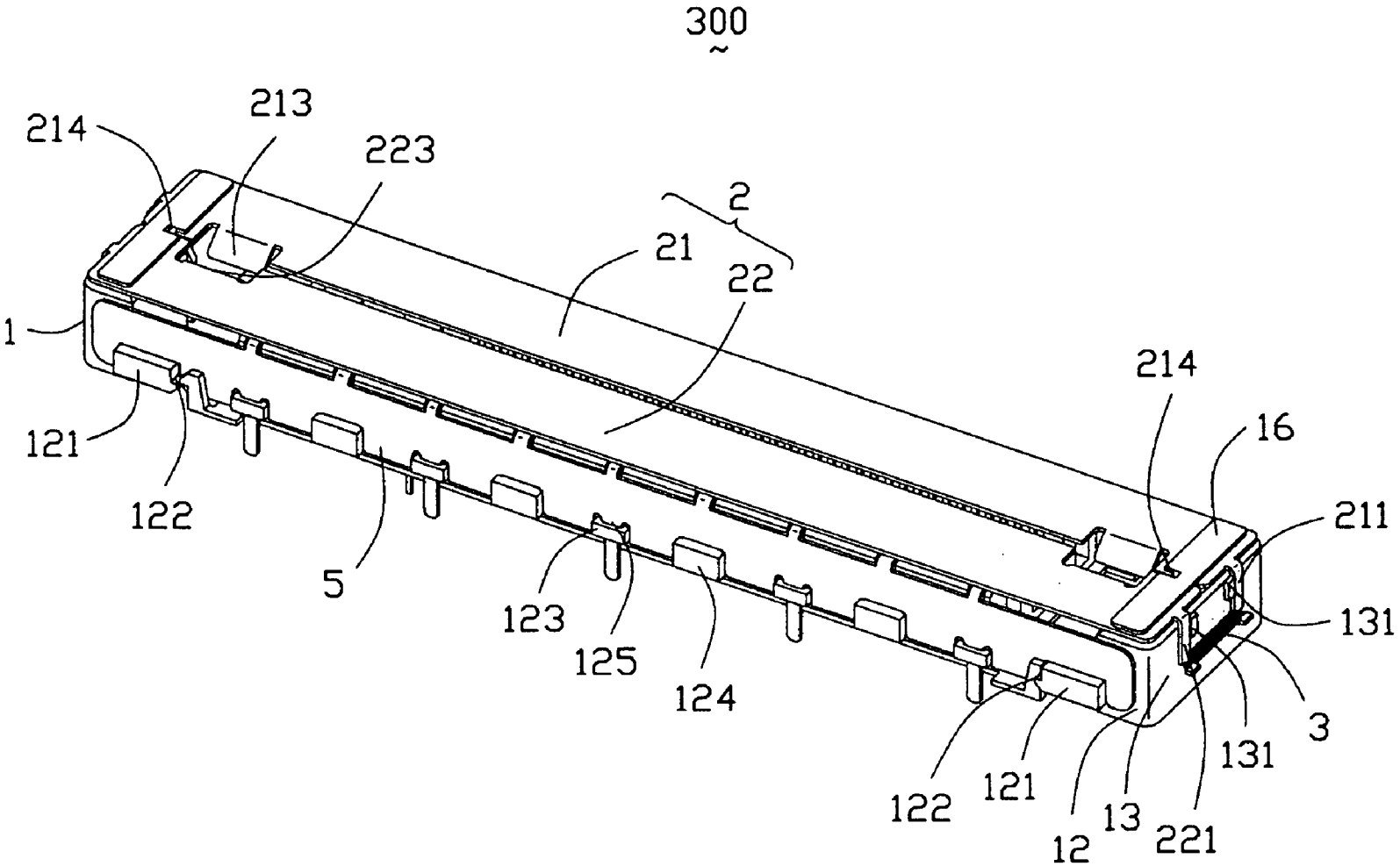
FIG. 1 is a perspective view of an electrical connector in accordance with the present invention.

Referring to FIG. 1, an electrical connector 300 in accordance with the present invention comprises an insulative housing 1, a plurality of terminals (not labeled) retained in the insulative housing 1, a shielding device 5, a positioning plate 17 and a shutter 2.

Figure 2:
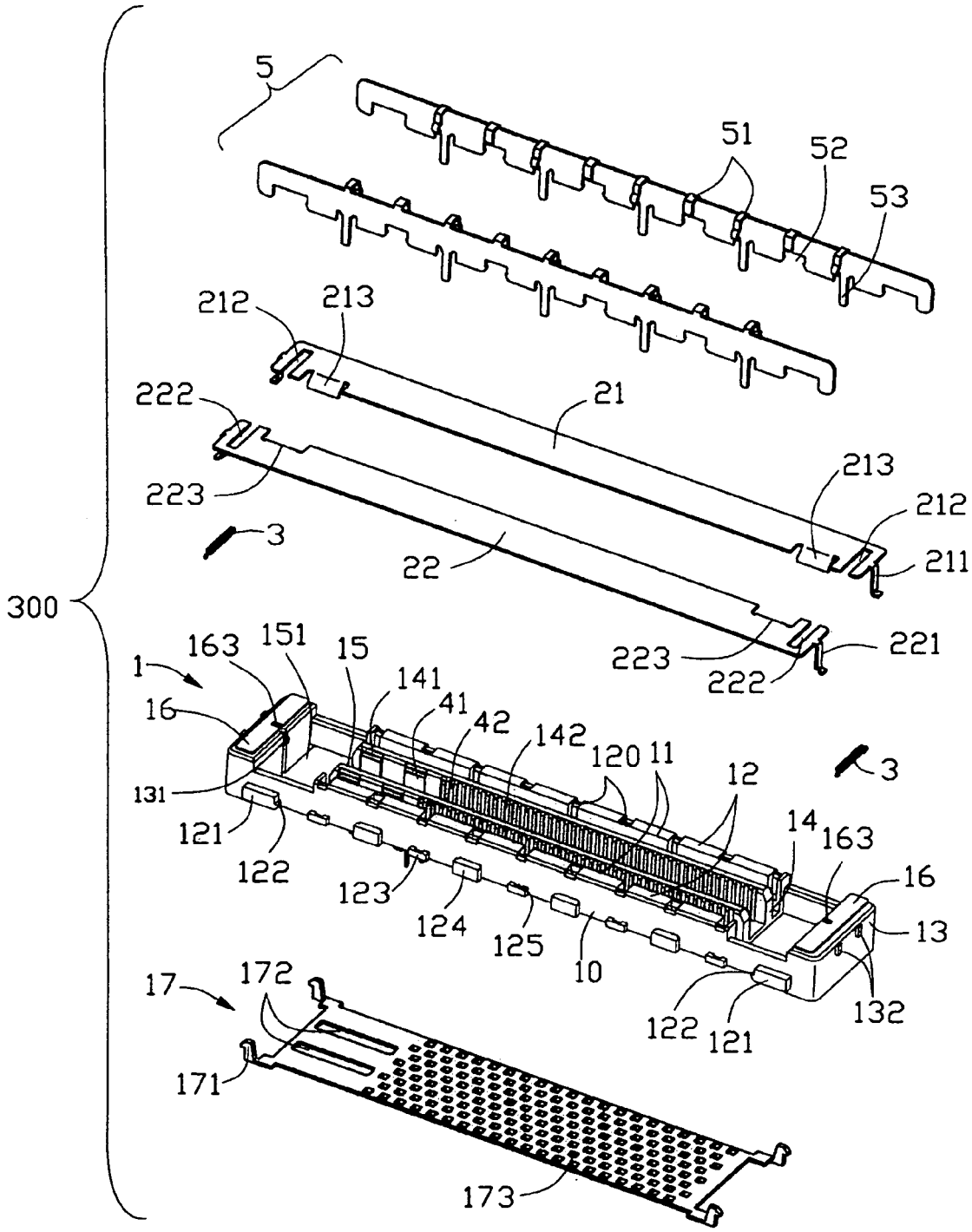
FIG. 2 is an exploded, perspective view of the electrical connector of FIG. 1.

Referring to FIG. 1 in conjunction with FIG. 2, the insulative housing 1 is substantially rectangular in shape and made out of a material such as a synthetic resin. The insulative housing 1 has a base 10, a pair of sidewalls 12, a pair of end walls 13 and a pair of elongate tongues 14 extending in the lengthwise direction of the insulative housing 1. A mating portion 11 for mating with a mating electrical connector 500 (shown in FIG. 4) is provided at an upper surface of the insulative housing 1, and a mating space 15 is defined between the base 10, the sidewalls 12 and the end walls 13, and comprises a pair of guiding chambers 151 in the vicinity of the end walls 13 respectively. Terminals retained in the insulative housing 1 are divided into three types: signal terminals 42, power terminals 41 and grounding terminals (not labeled).

The sidewalls 12 of the insulative housing 1 are opposite to each other, each sidewall 12 comprises a pair of latching member 121 with a bulge 122 protruding outwardly from the sidewalls 12 near the end walls 13 respectively. A plurality of locating members 123 with a through hole 125 and a plurality of protrusions 124 are formed in turn on the outside surface of each side wall 12 between two latching members 121 in turn. All of the locating members 121, the locating members 123 and the protrusions 124 are formed on lower portion of each sidewall 12. Each sidewall 12 further defines a plurality of cutouts 120 at up edge thereof.

Figure 3:
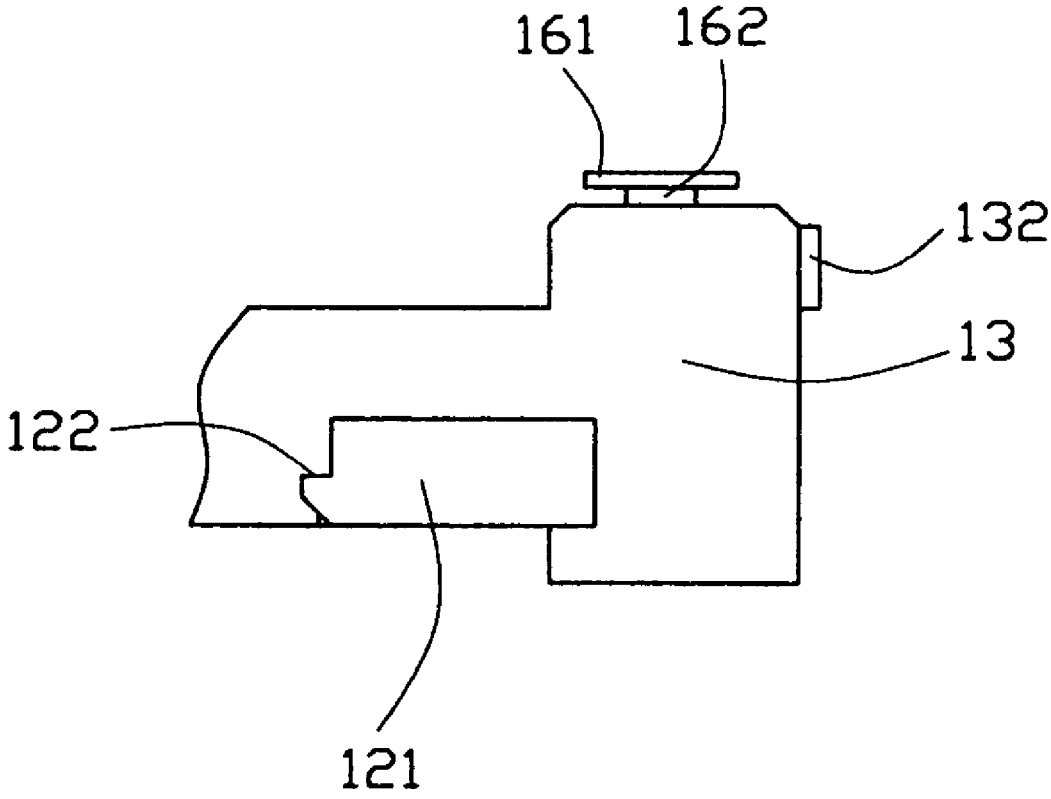
FIG. 3 is a partially side view of an insulative housing of the electrical connector of FIG. 1.

The pair of end walls 13 opposite to each other, and each end wall 13 comprises an first engaging portion 16 on an up surface thereof, two stopper member 132 on an outside surface thereof, and a groove 131 on an inside surface thereof throughout the base 10. Each first engaging portion 16 comprises a limitation section 161 and a first guiding section 162 along which the shutter 2 moves between a closed position and an open position. Referring to FIG. 3, the first engaging portion 16 has a T-shaped cross-section, the limitation section 161 is a flat member parallel to the up surface of the end walls 13, the first guiding member 162 is an elongate upright member. Height of the first guiding member 162 equals to thickness of the shutter 2. The limitation sections 161 and the first guiding sections 162 extend along the end walls 12, and each limitation section 161 further defines a gap 163 corresponding to the groove 131 to secure a grounding terminal (not labeled) at an inside edge thereof.

The elongate tongues 14 are formed within the mating space 15 and spaced apart from each other, and each elongate tongue 14 defines a plurality of direct smaller terminal passageways 142 for receiving signal terminals 42 and larger terminal passageways 142 for recovering power terminals 41 on both sides thereof, the larger terminal passageways 141 are defined at two side surfaces of one end of each elongate tongue 14, all of the passageways 141, 142 are throughout of the base 10.

The shutter 2 movably assembles with the insulative housing 1 to cover the mating portion 11 of the insulative housing 1, comprises a pair of shutter members 21, 22 and a pair of coil springs 3. The shutter members 21, 22 have symmetrical structures, and are arranged side by side in a plane. Take the shutter member 21 example for illustrating the structure of the shutter members 21, 22 in detail as below. The shutter member 21 is a substantially rectangle shaped plate, comprises a pair of arms 211 extending downwards from opposite ends in the lengthwise direction thereof, a pair of second engaging portion 212 adjacent to the ends, and a pair of oblique plates 213 inclining downwards from a main plate thereof. The second engaging portion 212 is an elongate slot opened on an inside edge near to the shutter member 22, and corresponds in dimension to the first guiding section. Width of the second engaging portions 212 is larger than that of the first guiding sections 162. The shutter member 22 comprises a pair of arms 221, a pair of second engaging portion 222 and a pair of oblique plates 223 as the shutter member 21. In assembly, the second engaging portions 212, 222 of two shutter members 21, 22 movably engage with two ends of one first guiding section 162 respectively below the limitation section 161. Each oblique plane 213 of one shutter member 21 opposite to each oblique plane 223 of another shutter member 22 respectively, and oblique plates 213, 223 are corresponding to locations of the guiding chamber 151. Each coil spring 3 connects two shutter members 21, 22 with two ends fixed to two arms 211, 221 of two shutter members 21, 22 in same ends respectively, and the stopper members 132 resist the arms 211, 221 to prevent the shutter members 21, 22 from overlapping.

The shielding device 5 for diverting the electrostatic discharge comprises a pair of shield members (not labeled), each shield member is made of metal and comprises a plurality of hooks 51 extending laterally and downwards from an up edge thereof, a plurality of cutouts 52 on an down edge thereof and a plurality of pins 53 extending downwards from the down edge thereof. Two shield members are assembled with the insulative housing 1, and the hooks 51 engage with the cutouts 120 respectively, the cutouts 52 fasten on the latching members 121 and the protrusions 124, and the pins 53 pass through the through holes 125 of the locating members 123.

The positioning plate 17 is a plate-shaped, defines a plurality of small holes 173 and two elongate holes 172 through the plate body, and the small holes 173 and elongate holes 172 are corresponding to the small terminal passageways 142 and the lager terminal passageways 141. Four latching members 171 extend upwards from four corners of the plate body for engaging with the bulges 122 of the latching members 121 of the insulative housing 1.

Figure 4:
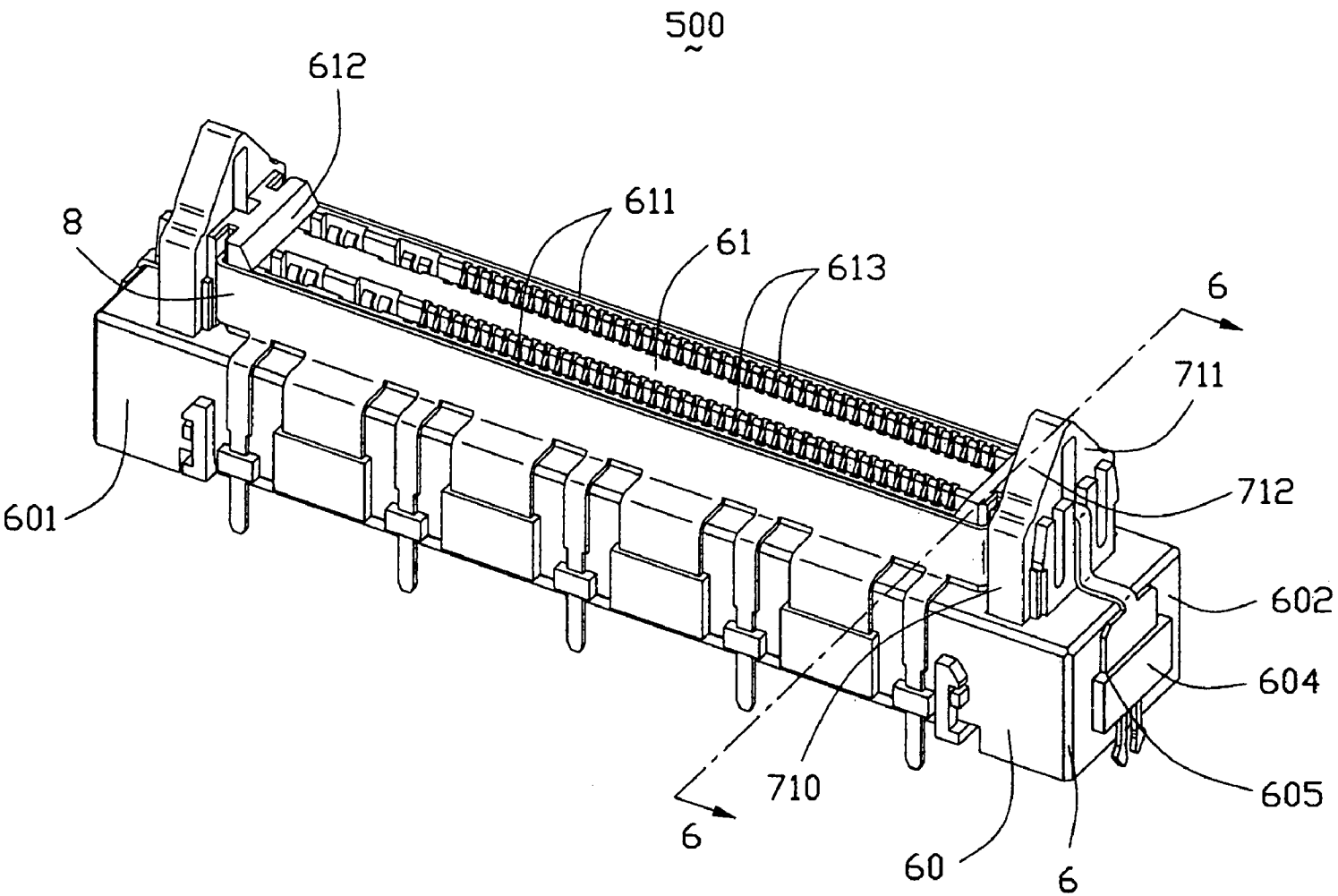
FIG. 4 is a perspective view of a mating electrical connector for engaging with the electrical connector shown in FIG. 1.
Figure 5:
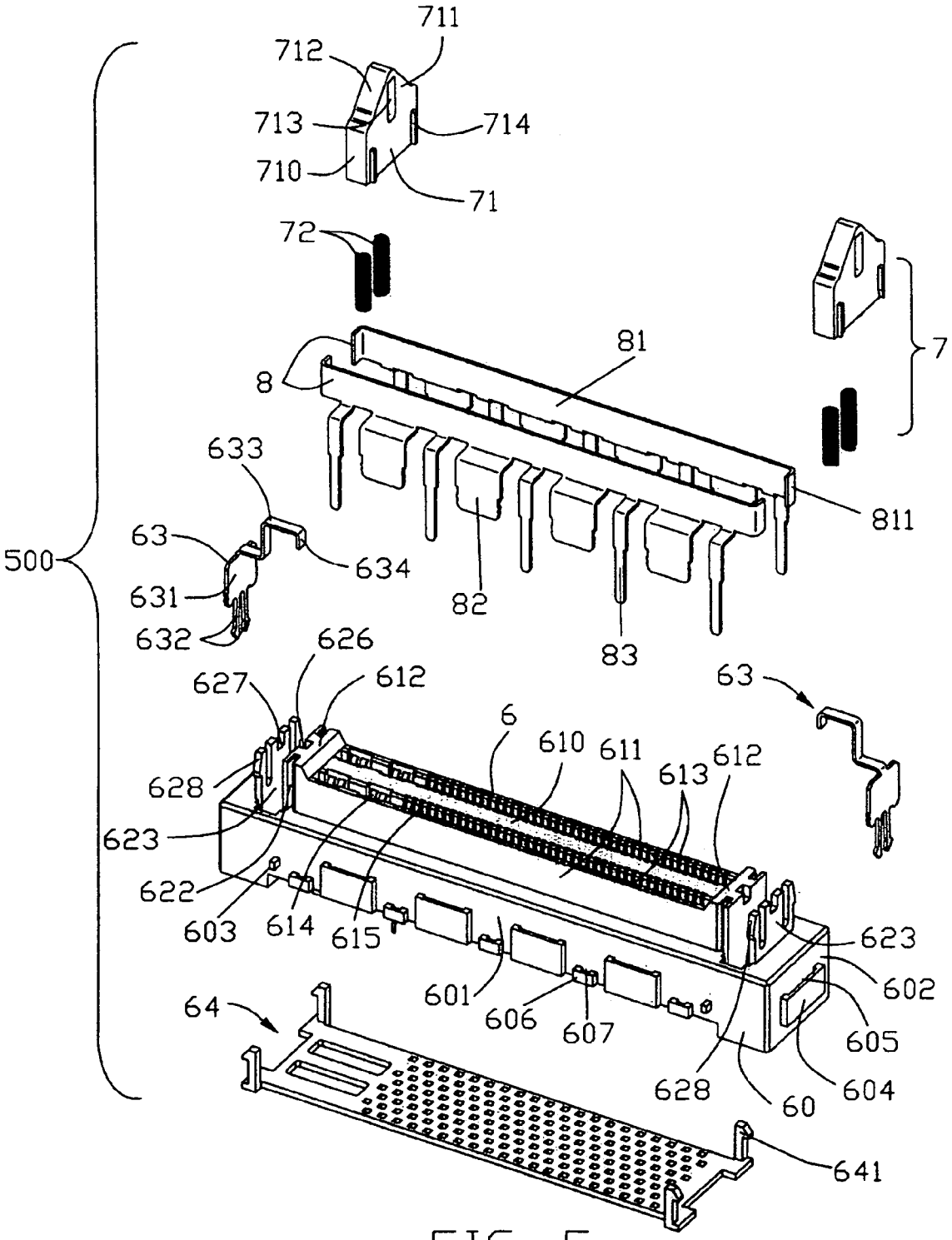
FIG. 5 is an exploded, perspective view of the mating electrical connector of FIG. 4.

Referring to FIGS. 4–5, the mating electrical connector 500 for mating with the electrical connector 300 comprises an insulative housing 6, a pair of guiding devices 7, a pair of shield plates 8, a positioning plate 64 and a plurality of terminals.

The insulative housing 6 comprises a base 60, a mating portion (not labeled) above the base 60 for mating with the electrical connector 300 and the guiding devices 7.

The base 60 has a general shape of an elongate club, comprises a pair of side faces 601 along lengthwise direction and a pair of end faces 602. Each side face 601 has a pair of tabs 603 for fixing the positioning plate 64, a plurality of positioning members 606 with a through hole 607 thereof. Each end face 602 has a positioning member 604 with a through hole 605 for positioning a grounding terminal. The base 60 further defines a space (not labeled) in bottom portion for receiving and locating the positioning plate 64.

Figure 6:
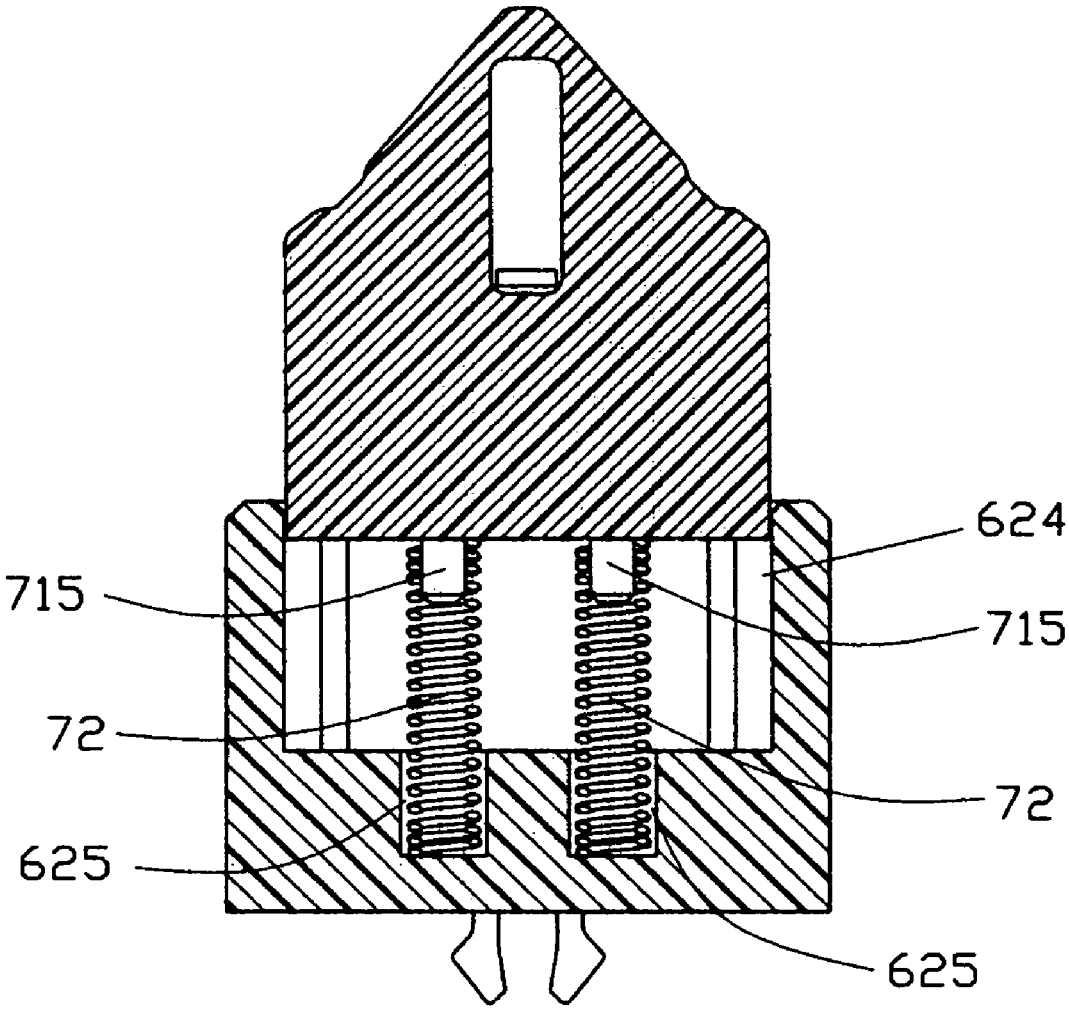
FIG. 6 is a cross-section view taken along line 6—6 of FIG. 4.

The mating portion has a middle portion (not labeled), a pair of upright walls 623 and two concave chambers (not labeled) each defined between the middle portion and each upright wall. The middle portion protrudes upwards from a center portion of the base 60, extends along the lengthwise direction of the base 60. The middle portion comprises a pair of lengthwise sidewalls 611, a pair of thick end walls 612 and a middle wall 610. The middle wall 610 parallels to two sidewalls 611 and connects to the end walls 612, two lengthwise receiving spaces (not labeled) for receiving the elongate tongues 14 of the electrical connector 300 are defined between the sidewalls 611 and the middle wall 610. A plurality of passageways 614, 615 are defined on inside surfaces of the sidewalls 611 and two opposite side surfaces of the middle wall 610. The passageways 614, 615 are throughout the base 60. Each end wall 612 comprises a cutout 626 at an up edge thereof and a pair of upright slots 622 opened on two laterals respectively in end wall 612. As shown in FIG. 6, the concave chambers are defined in the base 60 to detach the middle portion from the upright walls 623, the concave chamber comprises a cavity 624 with four grooves (not labeled) and two circular holes 625 extending downwardly from the cavity 624. Each upright wall 623 comprises a cutout 626 corresponding to the cutout 627 and a pair of latching tabs 628 on two ends thereof.

The guiding devices 7 assembled with the insulative housing 6 comprises a pair of guiding members 71 and two pairs of coil springs 72. The guiding members 71 are plates with substantial hill-shaped, each guiding member 71 comprises a body potion 710 and a top portion 711, the body potion 710 comprises two pairs of latching protrusions 714 on two side faces and two posts 715 extending downwards from bottom face thereof. The top portion 711 comprises a pair of guiding faces 712 and a through hole 713 through two side surfaces thereof. One guiding member 71 and a pair of coil springs 72 are located in one concave chamber, lower section of the body portion 710 are received in upper space of the concave chamber, one end of each coil spring 72 locates in each circular hole 625, and the other end of each coil spring 72 encircles around the post 715. The guiding members 71 can move down by means of the latching protrusions 714 sliding along the grooves 628.

The shield plates 8 cover the insulative housing 6, each shield plate 8 includes a main portion 81 for covering the sidewall 611 of the middle portion and a plurality of latching pieces 82 and pins 83. The main portions 81 have curving sections 811 at two ends thereof for attaching to the upright slots 622, and the latching pieces 82 and the pins 83 pass through the through holes 605 of the positioning members 604 respectively to fix the shield plates 8 on the insulative housing 6, as shown in FIG. 4.

Referring to FIGS. 4–5, the positioning plate 64 assembled to the bottom face of the insulative housing 6 comprises four locking members 641 for engaging with the tabs 603 and a plurality of aperture (not shown) corresponding to the passageways 614, 615.

Terminals received in the mating electrical connector 500 are divided into three types: signal terminals, power terminals and grounding terminals 63. The signal terminals and the power terminals are retained in the corresponding passageways 614, 615 with lower ends passing through the apertures 641 of the positioning plate 64. There are two grounding terminals 63 in the mating electrical connector 500, each grounding terminal 63 (as shown in FIG. 5) comprises a fixing end 633, a middle portion 631 and a grounding end 632. The fixing ends 633 have bending shape corresponding to mating face of the upright walls 623 and the base 60 to pass through the through holes 713 of the guiding devices 7 and assemble with the cutouts 626, 627 of the mating portions. The middle portions 631 are located in the insulative housing 6 by means of passing through the through holes 605 of the positioning members 604. The grounding ends 632 extend downwards from the middle portion 631, and each grounding end 632 has two grounding pins to electrically connect with a printed circuit board (not shown).

Figure 7:
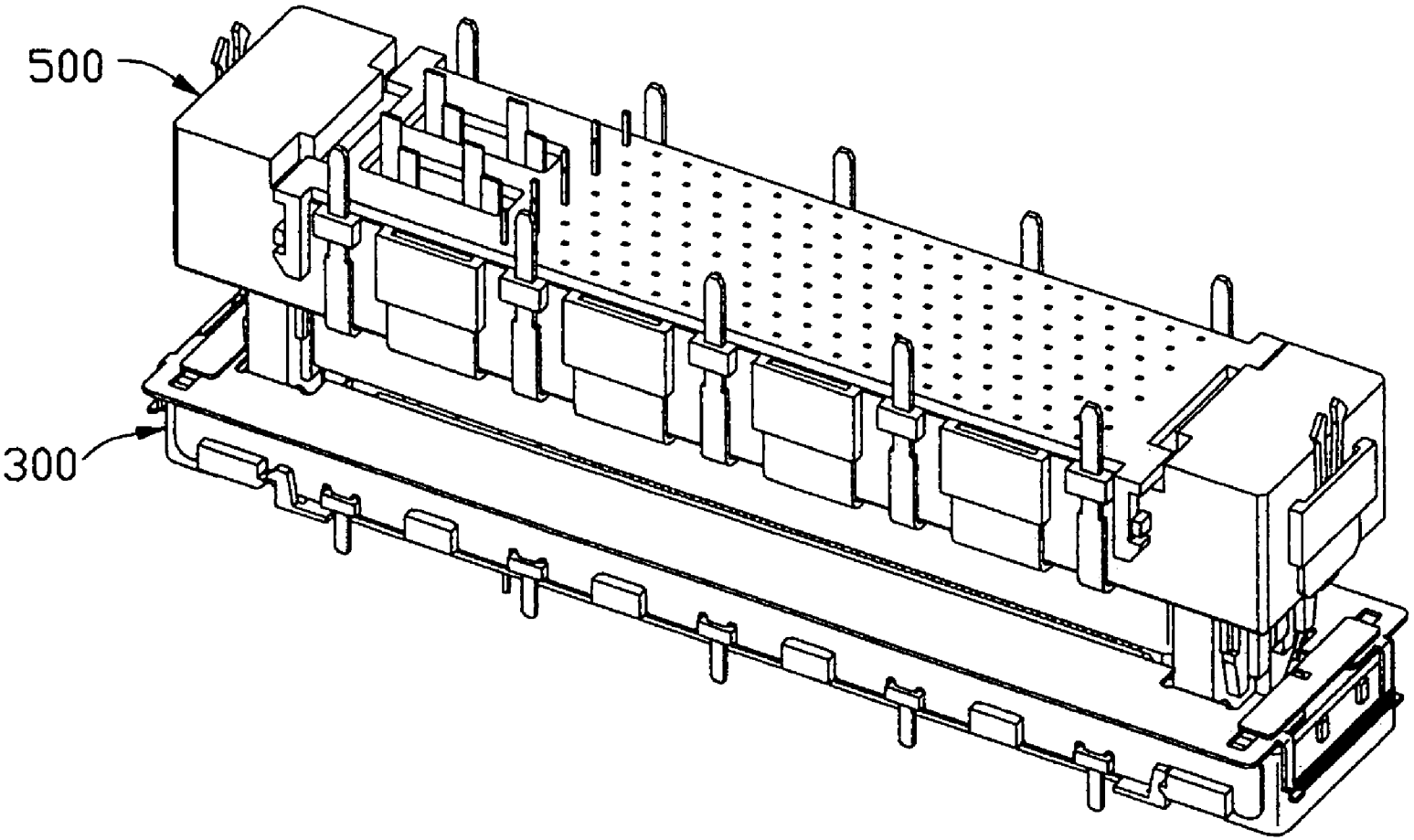
FIG. 7 is an assembled view of the electrical connector partially mating with the mating electrical connector.
Figure 8:
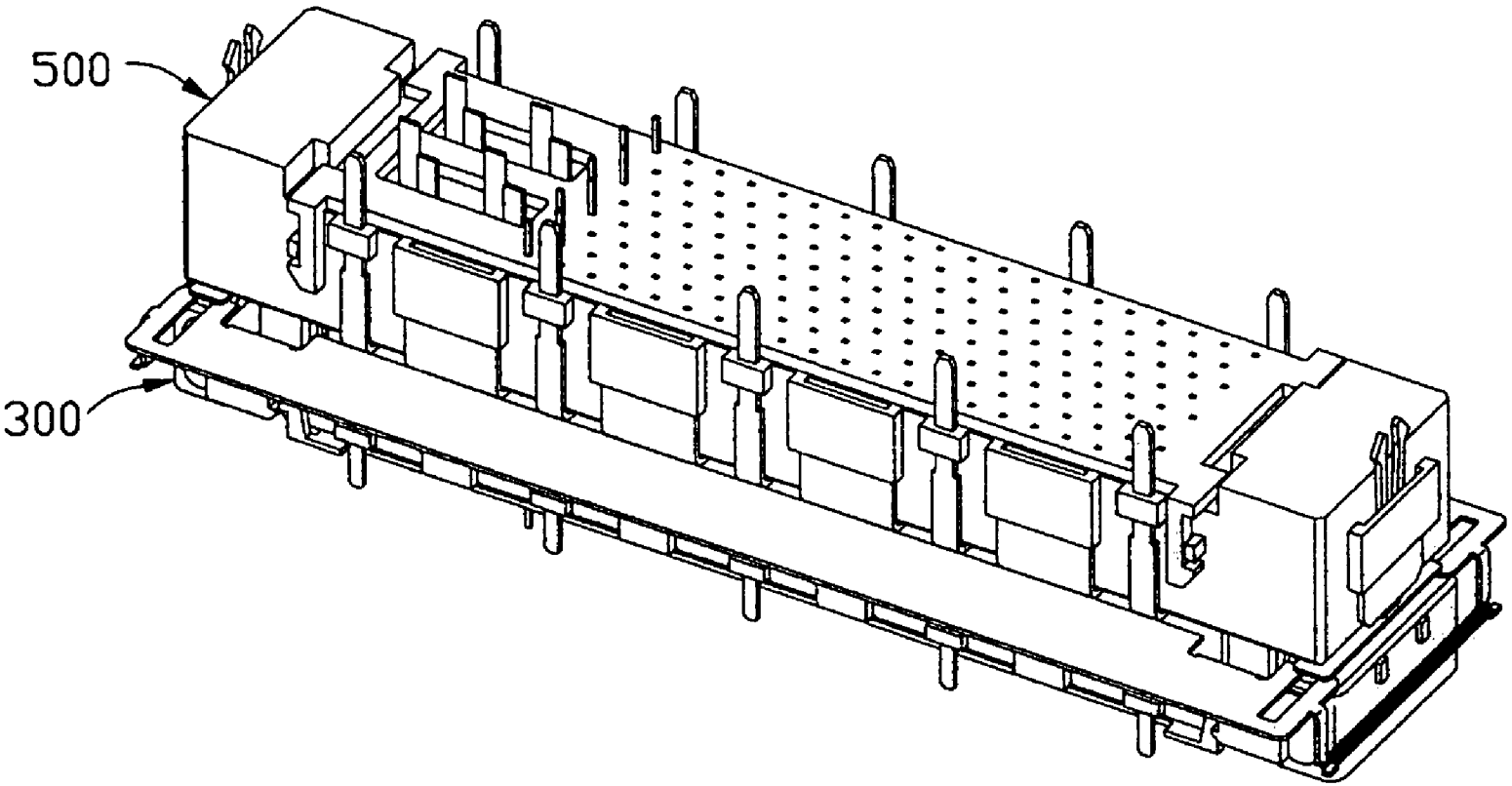
FIG. 8 is a view similar to FIG. 7, but the mating electrical connector mate with the electrical connector completely.

The mating electrical connector 500 and the electrical connector 300 mate to form an electrical connector assembly, as shown in FIG. 8. The process of mating the electrical connectors 300, 500 will now be described in greater detail with reference to FIGS. 7–8. As shown in FIG. 7, the mating electrical connector 500 reversed is positioned substantially adjacent to the electrical connector 300 such that guiding faces 712 of the top portions 711 of the guiding devices 7 comes into contact with the oblique plates 213, 223 of the shutter members 21, 22. In this state, the insulative housing 1 and the insulative housing 6 are not yet in contact, as the electrical connector 300 and the mating electrical connector 500 contact to each other, the top portions 711 of the guiding devices 7 push the oblique plates 213, 223 apart, due to the push force, the shutter members 21, 22 make transverse translation in the plane of the shutter members 21, 22 by the second engaging portions 212, 222 guiding along the first guiding section 162, and the shutter members 21, 22 just move in the plane due to the limitation section 161 until the mating portion 11 of the electrical connector 300 exposed at an open position. At the same time, the coil springs 3 become longer with larger elasticity. After then, the guiding devices 7 are received in the guiding chamber 151, and the electrical connector 300, 500 mate with each other with the terminals electrically connecting. If the mating electrical connector 500 is draw from the electrical connector 300, the resilience of the coil springs 3 actuate the shutter members 21, 22 to the initial closed status due to the outside force eliminating, the second engaging portions 212, 222 guide the shutter 2 to slide along the first guiding section 162 until the arms 211, 221 are stopped by the stopper members 132 at a closed position.

In the process above, the shutter members 21, 22 move between the closed position and the open position, the engagement portion 16 engages with the second engaging portion 212, 222 to form a guiding and limitation mechanism, which guide the shutter 2 to slide along the guiding mechanism in plane of the shutter 2 and limit the shutter 2 not divorce from the plane. Thus at the open position, the shutter 2 is parallel to and apart from the printed circuit board, sequentially, electrical components can be arranged on the printed circuit board around the electrical connector 300.

According to the principle cited above, the second engaging portion 211, 221 can be an elongate slot opened at inside edges of the shutter members 21, 22, and the first engaging portion 16 can be several T-shaped or reversed trapezoid-shaped bumps distributed discontinuously on the end walls of insulative housing 1; the first engaging portion 16 of the insulative housing 1 can be an elongate slot defined in the end walls 13, correspondingly, the second engaging portion 211, 221 can be a protrusion with a reversed T-shaped or trapezoid-shaped cross-section protruding from the lower surface of the shutter 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising:

a base, a pair of sidewalls and a pair of end walls projecting from the base;

a mating portion is defined between the base, the sidewalls and the end walls; and a first engaging portion is formed at each end wall;

a plurality of terminals received in the insulative housing;

a positioning plate for aligning a plurality of tail ends of the terminals is mounted to the base; and a shutter movably assembled to the insulative housing to close and open the mating portion of the insulative housing, the shutter comprising a second engaging portion mating with the first engaging portion to guide and limit the shutter to slide between a closed position and an open position in a substantially common plane perpendicular to a mating direction;

wherein the shutter comprises a pair of shutter members and a pair of coil springs, each coil spring is located at each of the pair of end walls, each coil spring connects two shutter members with two ends fixed to two shutter members in same ends respectively;

wherein the pair of coil springs urges the pair of shutter members to the closed position.

2. The electrical connector as claimed in claim 1, wherein the shutter members are substantially rectangle shaped plates and arranged on the mating portion side by side in a plane.

3. The electrical connector as claimed in claim 1, wherein the first engaging portion of the insulative housing is an elongate slot, correspondingly, the second engaging portion is a protrusion with a reversed T-shaped cross-section protruding from an lower surface of the shutter.

4. The electrical connector as claimed in claim 1, wherein the first engaging portion of the insulative housing is an elongate slot, correspondingly, the second engaging portion is a protrusion with a trapezoid-shaped cross-section protruding from an lower surface of the shutter.

5. The electrical connector as claimed in claim 1, wherein the second engaging portion is an elongate slot opened on an edge of the shutter.

6. The electrical connector as claimed in claim 5, wherein the first engaging portion has a T-shaped cross-section.

7. The electrical connector as claimed in claim 5, wherein the first engaging portion has a reversed trapezoid-shaped cross-section.

8. The electrical connector as claimed in claim 1, wherein the extension direction of the first engaging portion is the same as the extension direction of the second engaging portion, and comprises a limitation section and a first guiding section.

9. The electrical connector as claimed in claim 8, wherein the second engaging portion is an elongate slot opened on an edge of the shutter, and corresponds in dimension to the first guiding sections.

10. The electrical connector as claimed in claim 8, wherein the limitation section is a flat member parallel to an upper surface of the insulative housing, the first guiding member is an elongate upright member.

11. The electrical connector as claimed in claim 10, wherein the first engaging portion is several T-shaped bumps distributed discontinuously on the end walls of the insulative housing.

* * * * *